US009919777B2

(12) United States Patent
Bowler, II

(10) Patent No.: US 9,919,777 B2
(45) Date of Patent: Mar. 20, 2018

(54) TOWABLE RECREATIONAL CRAFT

(71) Applicant: Roland K Bowler, II, Kildeer, IL (US)

(72) Inventor: Roland K Bowler, II, Kildeer, IL (US)

( * ) Notice: Subject to any disclaimer, the term of this patent is extended or adjusted under 35 U.S.C. 154(b) by 24 days.

(21) Appl. No.: 14/698,783

(22) Filed: Apr. 28, 2015

(65) Prior Publication Data

US 2016/0318588 A1 Nov. 3, 2016

(51) Int. Cl.
*B63B 35/81* (2006.01)
*B63B 7/08* (2006.01)

(52) U.S. Cl.
CPC ..... *B63B 35/81* (2013.01); *B63B 7/08* (2013.01); *B63B 2035/813* (2013.01); *B63B 2035/818* (2013.01)

(58) Field of Classification Search
CPC ..... B63B 35/81; B63B 35/811; B63B 35/812; B63B 2035/813; B63B 35/815; B63B 35/816; B63B 35/817; B63B 2035/818; B63B 7/08; B63B 7/082
USPC ..... 114/242, 246, 248, 253; 440/14, 15, 22; 441/65–73; D12/803, 809
See application file for complete search history.

(56) References Cited

U.S. PATENT DOCUMENTS 1,587,605 A * 6/1926 Scroggins ..... A63B 35/00 440/17
2,871,491 A * 2/1959 Van Vorst ..... B63C 9/08 441/66
2,928,109 A * 3/1960 Wilber ..... B63B 35/817 441/73
2,986,751 A * 6/1961 Baren ..... B63B 7/08 441/66
3,156,483 A * 11/1964 See ..... A47C 27/081 280/18
3,491,997 A * 1/1970 Winters ..... A63H 23/10 440/15
3,529,565 A * 9/1970 Iglesias ..... A63B 35/02 441/55
3,714,921 A * 2/1973 Gibson ..... B63B 7/08 441/129
4,172,427 A * 10/1979 Kindred ..... B63B 35/73 403/233
4,413,832 A * 11/1983 Pendleton ..... A63C 5/00 280/18
4,708,676 A * 11/1987 Lin ..... B63B 35/73 440/27
5,354,222 A * 10/1994 Elias ..... B63B 21/56 114/249
6,053,790 A * 4/2000 Langford ..... A63G 21/18 114/248
D480,442 S * 10/2003 Peterson ..... D21/770
D662,564 S * 6/2012 Peterson ..... D21/803

* cited by examiner

*Primary Examiner* — Ajay Vasudeva

(57) ABSTRACT

A towable recreational craft having a body member for accommodating one or more riders in a prone position is disclosed. One or more stabilizing members are movably coupled to and extend away from an aft portion of the body member. Each stabilizing member includes a foot-accommodating portion spaced apart from the body member, wherein the stabilizing member is movable between a position extending away from the aft portion of the body member and a position adjacent a lateral portion thereof to provide greater stability as the craft is towed.

20 Claims, 4 Drawing Sheets

TOWABLE RECREATIONAL CRAFT

FIELD OF THE DISCLOSURE

The present disclosure relates generally to towable recreational craft accommodating one or more riders and more particularly to towable recreational craft having improved stability.

BACKGROUND

Towable recreational watercraft are known generally and are typically towed across the water by a towline fastened to a moving object like a power boat. Such watercraft have been embodied as an inner tube or inflatable body member having a towline fastened to a front portion thereof. It's also known to cover the body member with a durable nylon material, to which a towline hitch and handles are fastened. It is also known to tow such watercraft and other devices over snow with a snow machine.

In use, recreational watercraft accommodate one or more human riders in a seated or prone position. When known watercraft are towed behind a power boat the watercraft may become unstable and tip from one side or the other when crossing a wake drawn behind the boat. Windswept waves or waves caused by other boats may also cause the watercraft to tip. There is also a tendency for such watercraft to tip or overturn when towed along a curved path, for example when towed by a power boat negotiating a tight turn. The tendency to tip while negotiating a turn exists irrespective of the calmness of the water and is aggravated when turning in the presence of waves.

The objects, features, and advantages of the disclosure will be evident from the following description of one or more embodiments herein, with reference to the accompanying drawings.

DETAILED DESCRIPTION

While the drawings illustrate various aspects of the disclosure, the elements of the various figures are not necessarily drawn to scale. The size, shape and dimensions of some portions, features, components and/or regions of the drawings may be disproportionate to provide clarity or to better convey or illustrate what is described herein.

Figure 1:
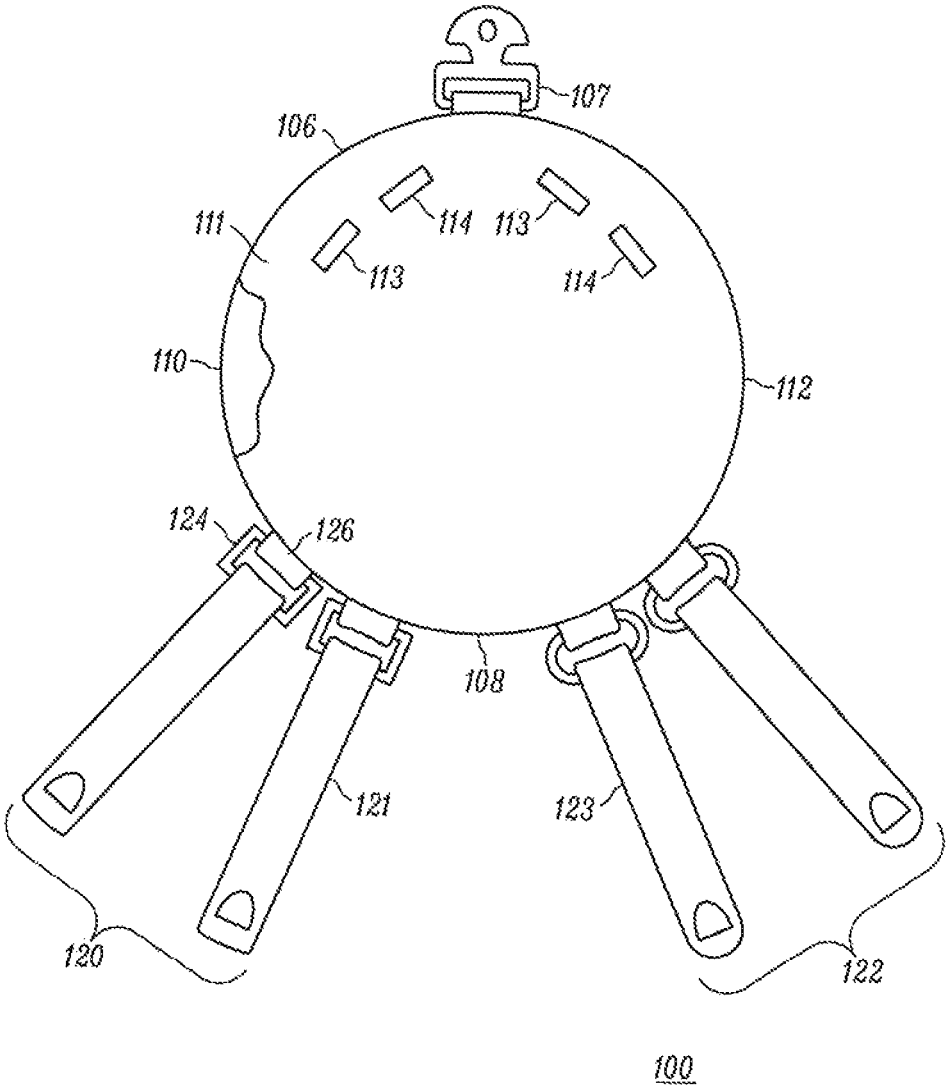
FIG. 1 is a plan view of a towable recreational craft.
Figure 2:
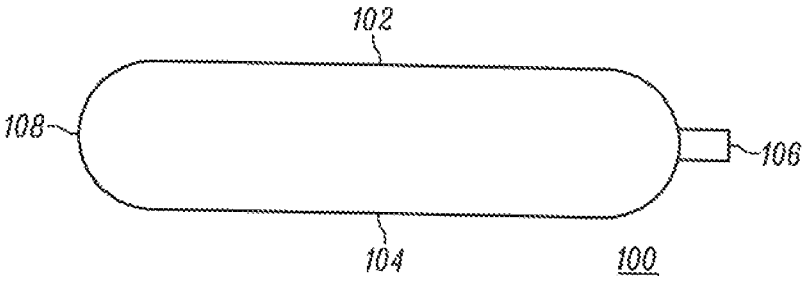
FIG. 2 is a side view of a towable recreational craft.

FIG. 1 illustrates a towable recreational craft 100 comprising a body member 110 having a top side 102, an opposite bottom side 104, a front portion 106, and a rearward portion 108. The recreational craft could be towed across water or snow. As shown, the body member has opposite lateral portions 110, 112 disposed between the front portion 106 and the aft or rearward portion 108. The body member may comprise a buoyant or semi-buoyant material. The body member may be embodied as an inflatable device like a tyre inner tube or inflatable device, which may have a variety of different shapes. An inflatable body member may be embodied as an inflatable rubber, polyvinyl chloride (PVC) or other suitable natural or synthetic material. Alternatively, the body member may be embodied as a non-inflatable device like a closed-cell extruded polystyrene material (e.g., Styrofoam) or some other non-inflatable buoyant or semi-buoyant material. Various other natural or synthetic materials may also be used for the body member. The craft may include a hitch to which a towline is fastened. In FIG. 1, a hitch 107 is fastened to the front portion of the body member. In other embodiments, the towline is tied directly to the body member or fastened to a net disposed about the body member to distribute pulling forces applied thereto.

The illustrated body member has a generally circular shape when viewed from the top or bottom. In other embodiments, the body member could have most any other shape. Such other shapes include but are not limited to an oblong or oval, rectangular, triangular, square or some other polygon or quasi-polygonal shape. Generally, the surfaces of the top and bottom sides of the body member may be flat or non-flat. For example, the bottom side surface could be convex or concave. The body member may also have a central keel or one or more fins or skegs extending from the bottom side thereof for directional stability. The fins or skegs may be disposed laterally or along the centerline. In some embodiments, the fins or skegs are adjustably retractable. Whether the bottom side surface is concave or convex may have some bearing on the placement of any fins or skegs. The top side surface of the body member is generally configured to accommodate one or more riders in the prone position with legs and feet extending from the aft and lateral portions of the body member. Thus the top surface may have a flat, convex, or concave configuration. In one particular embodiment, the top surface has a somewhat concave recess extending between the front and rearward portions of the body member. In another embodiment, the top surface has two or more generally side-by-side concave recessed portions for accommodating two side-by-side riders. A centerline of the concave recesses may be parallel or divergent toward the rearward portion of the body member.

In one embodiment the inflatable or non-inflatable body member is covered with another material like nylon or PVC or some other material. For example, the body member may be encapsulated by a nylon or neoprene sheath, or a plastic shell or some other material. FIG. 1 shows a portion of the sheath or shell 111 removed from the body member. The body member may also be covered by a combination of these and other materials. A sheath-type covering may include an opening through which to accommodate the body member. Such an opening may be securely closeable with a zipper, or buttons, or by mating hook and loop straps like Velcro, or by some other secure fastening mechanism. The opening in the sheath may be relatively small to accommodate an inflatable body member, but the opening could be relatively large to accommodate a non-inflatable body member. Alternatively, a shell-type covering may be fastened to, or integrally formed about, the body member. For example, a non-inflatable body member may include a shell made of plastic or some other durable material fastened thereto by an adhesive or by separate molding operations or by other means. Alternatively, the body member has no such covering. The materials selected will depend on consideration of the intended use or application of the craft. For applications where the craft is towed over snow, for example, materials having less frictional drag may be advantageous. In some applications however some drag may be desirable for directional stability.

In some embodiments, the body member includes a handle disposed at or near the front portion thereof for grasping by a rider. The handle could take many forms. For example, there could be a single elongated handle for grasping by one or more riders. Alternatively, the handle could be embodied as a pair of handles, one for grasping by each hand of the rider. FIG. 1 illustrates the body member having two sets of handles 113, 114 on the top side near the front portion. In this embodiment, each pair of handles accommodates a corresponding one of two riders in a prone position. In embodiments where the body member includes a sheath, the handles may be embodied as straps sewn, riveted or otherwise fastened to the sheath. Alternatively, the one or more handles may be embodied as an integral part of the body member or a plastic shell thereof. For example, such handles could be formed as a unitary part of the body member by a molding process or by some other process. In embodiments devoid of a sheath or shell covering the buoyant body member, the one or more handles may be fastened directly to the body member. In other embodiments, the watercraft is devoid of handles, wherein the rider merely grasps a front portion of the body member with his or her arms.

In one embodiment, the body member includes one or more stabilizing members movably coupled thereto. The stabilizing member extends generally away from the body member and is movable between a position extending away from the rearward portion of the body member and a position extending away from one or both the lateral portions of the body member. Each stabilizing member includes a foot-accommodating portion spaced apart from the body member.

Figure 11:
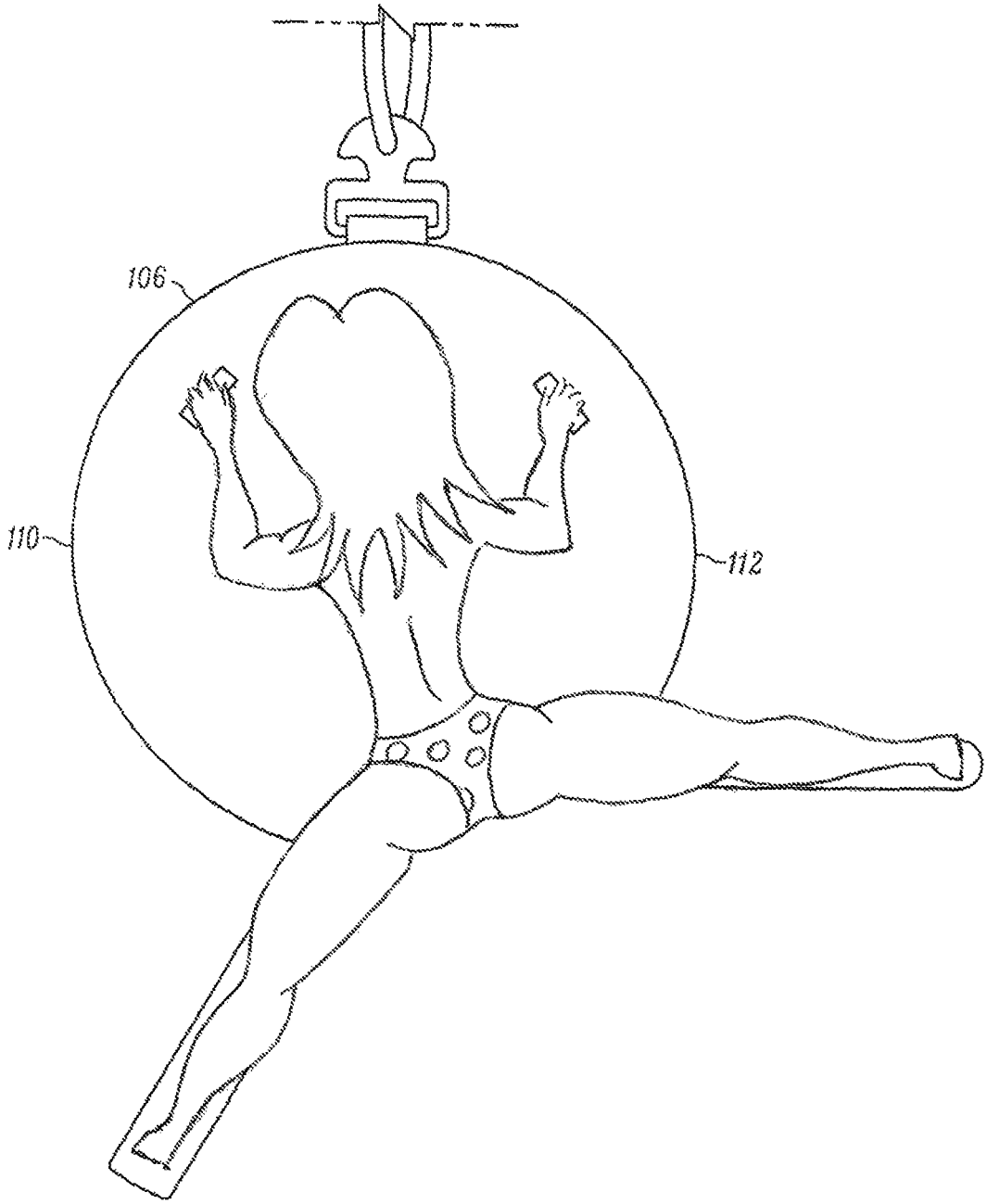
FIG. 11 is a plan view of a towable recreational craft with a rider.

In operation, a rider assumes a prone position on the top side of the body member with the rider's legs extending from the rearward portion thereof. The rider is positioned to grasp the recreational craft with his or her hands or arms as discussed above. One or both of the rider's feet are disposed in a foot-accommodating portion of the one or more stabilizing members. For the case where there are two stabilizing members, each foot is disposed in a foot-accommodating member of a corresponding stabilizing member. The articulating nature of the stabilizing members allows the user's legs to move independently between the aft position and the lateral sides 110, 112 of the body member thereby providing improved stability as the recreational craft is towed across the water or snow as shown in FIG. 11. The positioning of the rider's leg or legs toward the lateral portion of the body member will reduce the likelihood that the body member will tip, for example while negotiating a turn or rough water. For the case where there is a single stabilizing member, the foot accommodating member may be sized to accommodate both feet of the rider. The articulating nature of the single stabilizing member allows the rider's legs to move in unison from side to side, thereby providing stability as the craft is towed across the water or snow. Alternatively, the rider could alternate which foot is disposed in the foot-accommodating portion of the single stabilizing member depending on which side of the body member the rider wants to position the stabilizing member for stability, while allowing the other leg to extend from the aft portion of the body member.

In one embodiment, the one or more stabilizing members include a directional guiding member extending from a bottom side thereof. The stabilizing member is disposed a sufficient distance from the body member to allow the directional guiding member to extend into the water or snow and to provide rudder-like functionality as the craft is towed. The directional guiding member could be part of the foot-accommodating member or a discrete member separate therefrom. In either case, the directional guiding member is maintained in the water or snow by downward pressure from the rider's foot disposed in the foot-accommodating portion of the stabilizing member. Thus the directional guiding member provides the rider a measure of control over the direction of the craft.

In FIG. 1, the body member includes two pair of stabilizing members extending from the aft portion of the body member. In this embodiment, the first pair of stabilizing members 120 accommodates one rider and the second pair of stabilizing members 122 accommodates an adjacent rider. The pairs of stabilizing member 120, 122 are shown disposed symmetrically about a centerline of the body member. In another embodiment, only a single pair of stabilizing members, for example, members 121, 123 in FIG. 1, are disposed symmetrically about the centerline to accommodate a single rider. In another embodiment, a single stabilizing member, not shown, extends from the aft portion of the body member to accommodate a single rider as discussed above.

The one or more stabilizing members are movably fastened to corresponding retaining members formed in or fastened to the body member. In FIG. 1, the stabilizing member is embodied as a strap fastened to a retaining member 124 embodied as a ring or rectangular or D-shaped member fastened to the body member by an anchor 126. In this embodiment, the one side of the retaining member is captured by the anchor 126 and the other side of the retaining member retains the stabilizing member. A curved shape retaining member may better accommodate articulation of the stabilizing member.

In one embodiment, the one or more stabilizing member are embodied as straps formed of a nylon material. In some applications the stabilizing strap is strengthened with a carbon fiber cloth or other reinforcing material captured between layers of the strap. The stabilizing strap may be fastened to the retaining member (e.g., the D-shaped member) by forming a loop that captures the retaining member upon sewing or riveting or otherwise fastening together mating portions of the strap. In FIG. 1, the one or more anchors 126 are fastened directly to, or formed integrally with, the body member. In embodiments where the body member includes an outer sheath, the anchors and sheath may constitute a unitary member. Alternatively, the anchors may be discrete parts that are sewn, riveted or otherwise fastened to the sheath. In some applications the anchor is strengthened with a carbon fiber cloth or other reinforcing material captured between layers of the anchor and between layers of the sheath at least in the region where the anchor is fastened thereto. Alternatively, the stabilizing strap may be attached directly to the sheath without the intermediate retaining member. In other embodiments, the retaining members are integrally formed with the body member. For example, the retaining members may be formed as part of the body member, or as part of a body member shell, in a molding or other forming operation.

In other embodiments, the stabilizing member may have other forms. For example, the stabilizing member could be embodied as a cord with one end fastened to the body member wherein the other end fastened is fastened to, or is integrally formed with, a foot accommodating portion. The cord could be made of nylon or some other material with suitable tensile strength. The cord could be rigid or flexible. A rigid cord would require a movable coupling to the body member, for example with a retaining ring. A flexible cord could be anchored directly to the body member without the need for an intermediate retaining member. Various other mechanisms and materials may be employed to form the one or more stabilizing members and to fasten them to the body member or to a sheath or covering disposed about the body member.

Figure 3:
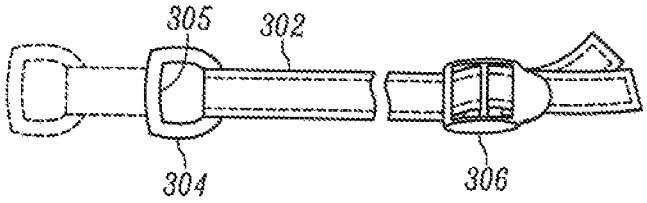
FIG. 3 is a plan view of a stabilizing member.
Figure 4:
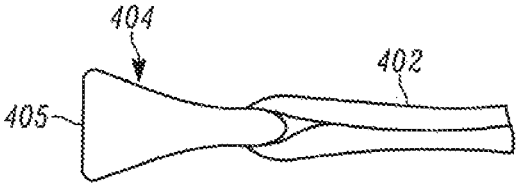
FIG. 4 is a side view of a stabilizing member.
Figure 5:
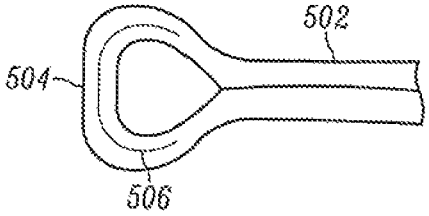
FIG. 5 is a plan view of another stabilizing member.
Figure 6:
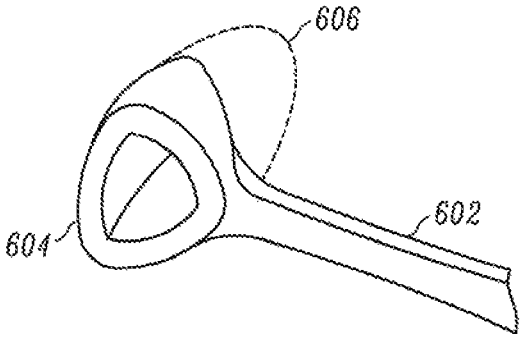
FIG. 6 is a perspective view of another stabilizing member.

In one embodiment, the foot-accommodating member comprises a stirrup into which the user's foot is disposed. FIG. 3 is plan view of a stabilizing member portion 302 embodied as a strap having a stirrup 304 fastened to an end thereof. The stirrup has a relatively flat portion 305 that supports the user's foot. FIG. 4 is side view of a stabilizing member portion 402 embodied as a strap looped through a stirrup 404. The strap has mating portions stitched, riveted or otherwise fastened together to capture the stirrup. FIG. 4 shows the foot support 405 having increased surface area to more comfortably accommodate the user's foot. In one embodiment, the stabilizing member is made of nylon, or a carbon fiber reinforced material or other suitably strong material. FIG. 5 illustrates a stabilizing member embodied as a strap 502 including an open loop 504 formed at the distal end thereof into which the user's foot may be disposed. In embodiments where the strap comprises a flexible material like nylon, a rigid member 506 may be embedded between layers of material to provide greater rigidity to the stirrup and to reduce a tendency of the non-rigid stirrup to clamp the user's foot when under load. The stirrup of FIGS. 3 and 4 may be made of plastic, carbon fiber or some other material having suitable strength, durability and water resistance. In FIG. 6, the stabilizing member is embodied as a cord 602 with a stirrup 604 disposed at the distal end thereof. The stabilizing member and stirrup may constitute a unitary member or the stirrup may be a discrete part fastened to the stabilizing member.

Figure 7:
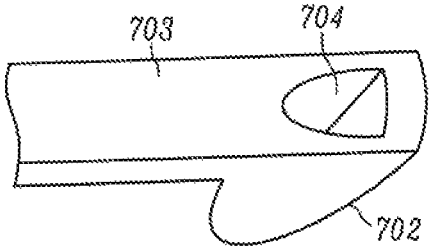
FIG. 7 is a perspective view of another stabilizing member.

In FIG. 7, the stirrup is part of a foot-accommodating pocket 702 protruding from a bottom side of the stabilizing member 703. The pocket is accessible via an opening 704 on a top side of the stabilizing member. In FIG. 7, the pocket is a open-ended boot-like member formed integrally with, or fastened to, the stabilizing member. A toe portion of the pocket may be fully or partially closed to fully or partially protect the user's feet. For aquatic applications, a closed-ended boot may have one or more holes to permit fluid drainage while still providing substantial foot protection. In one embodiment, the pocket is a non-rigid material, like nylon, that is integrally formed with a stabilizing member comprising the same or similar material. For example, the pocket could be formed integrally with a strap portion of the stabilizing member. Alternatively, the boot could be formed of a rigid or semi-rigid material like plastic, or rubber, or some other suitable material that is fastened to the stabilizing member. In one embodiment, the boot has a relatively rigid outer shell with a softer inner lining for greater comfort. The inner lining could be formed of foam rubber or some other suitable material. In one embodiment, a plastic boot is sewn, riveted or otherwise fastened to a strap-shaped stabilizing member. FIG. 6 illustrates the stirrup fastened to a cord wherein the stirrup has a fully or partially closed end portion 606. The cord could be flexible or rigid. If the stabilizing member is inflexible, then it could be movably coupled to the body member by a retaining member to permit articulation as discussed herein.

Figure 8:
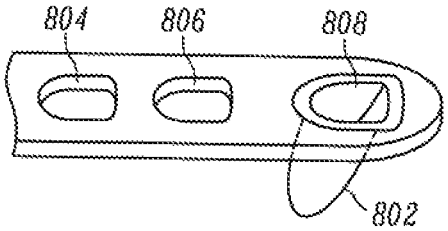
FIG. 8 is a perspective view of another stabilizing member.

In one embodiment, the foot-accommodating portion is adjustably spaced apart from the body member. An adjustable foot-accommodating portion accommodates different sized riders and it accommodates different positioning of the rider on the body member. In one embodiment, shown in FIG. 3, adjustment is provided for a strap-like stabilizing member using an adjustable tension buckle 306 disposed between the foot-accommodating portion and the body member. In this embodiment, the strap is looped through a retaining member and threaded through the adjustable tension buckle, wherein the strap length is adjustable by feeding more or less strap through the buckle. Such a buckle could be implemented in the embodiments of FIG. 3 and FIG. 7. In another embodiment, adjustment is provided by a plurality of foot-accommodating portions spaced apart along the stabilizing member at different locations from the body member wherein the rider could utilize the foot-accommodating member at the most appropriate distance from the body member. For example, multiple stirrups could be linked together with intervening strap portions as shown in broken lines in FIG. 3. Similarly adjustment could be provided with multiple pockets arranged in series along the stabilizing member of FIG. 7. In the alternative embodiment of FIG. 8, adjustability is provided by an open-ended rigid or semi-rigid boot 802 removably disposed in any one of several openings 804, 806 or 808 formed along the stabilizing member. The boot could be retained in the opening by friction fit or by Velcro or by clamping a portion of the stabilizing member between a flange of the boot and a mating ring or strip or material. The ring or material strip could be fastened to the flange using removable bolts or other fasteners.

Figure 9:
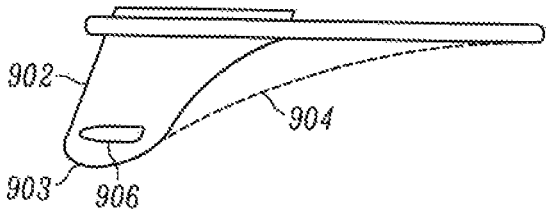
FIG. 9 is a side view of another stabilizing member.
Figure 10:
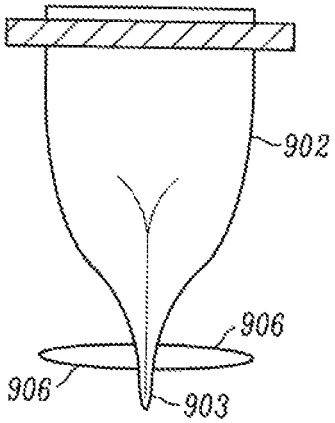
FIG. 10 is an end view of FIG. 9.

In one embodiment, an outer portion of the boot constitutes the directional guiding member extending from the stabilizing member. FIG. 9 illustrates the boot 902 having a fin shaped portion 903. The fin provides the rider with a measure of control over how the stabilizing member and to some extent the body member track over the snow or water. Alternatively, the directional guiding member may be a discrete member spaced separate and apart from the boot, for example toward a distal end of the stabilizing member away from the body member. In some embodiments, drag produced by the boot is reduced by providing an elongated tapered portion 904 (shown in broken lines) extending from the boot toward the body member. The tapered portion may be an integral part of the boot or the tapered portion may be a separate part that is fastened to the boot and or the stabilizing member. The tapered portion could also be an integral part of the stabilizing member or the tapered portions could be formed unitarily with the stabilizing member. In some embodiments, one or more winglets extend laterally from a lower portion of a boot. The one or more winglets are used mostly for aquatic applications and are optional. The winglets are positioned to remain under water, enabling the rider to better maintain the boot or stabilizing member in the water. In one embodiment, a single winglet extends from an aft portion of a lower part of the boot. The winglet may also extend from lateral sides or an aft portion of the fin or directional guiding member. FIG. 9 also illustrates the directional guiding member including laterally extending winglets 906. FIG. 10 is a front view of the boot 902 having a fin-shaped portion 903 as shown in FIG. 9. The fin and winglets can be embodied as separate accessories fastened to the boot or directional guiding member or the one or more winglets can be an integral part of the fin or the boot or both.

While the disclosure and what are presently considered to be the best modes have been described in a manner that establishes possession thereof by the inventor and that enables those of ordinary skill in the art to make and use the same, it will be understood and appreciated that there are many equivalents to the embodiments disclosed herein and that myriad modifications and variations may be made thereto without departing from the scope and spirit of the disclosure, which is to be limited not by the exemplary embodiments but by the appended claims.

The invention claimed is:

1. A towable recreational craft comprising:

an inflatable body member having a top side, an opposite bottom side, a front portion, an aft portion, and opposite lateral portions between the front portion and the aft portion, a tow-rope hitch coupled to the body member;

a non-inflatable elongated stabilizing member having a first end portion movably coupled to the body member;

a foot-accommodating stirrup coupled to another end portion of the non-inflatable elongated stabilizing member and spaced apart from the body member, the non-inflatable elongated stabilizing member movable between a position extending away from the aft portion of the body member and a position adjacent one of the lateral portions of the body member when a rider's foot is disposed in the stirrup.

2. The towable recreational craft of claim 1, wherein the stirrup is part of a foot-accommodating pocket coupled to the non-inflatable elongated stabilizing member, the foot-accommodating pocket having an open-end portion, a substantially closed-end portion, and an inner portion accessible from the open-end portion.

3. The towable recreational craft of claim 2, wherein the body member includes an outer sheath and a closed-loop retaining member interconnecting the non-inflatable elongated stabilizing member to the outer sheath of the body member.

4. The towable recreational craft of claim 1 further comprising an adjustable tension buckle disposed along the non-inflatable elongated stabilizing member, wherein the adjustable tension buckle adjusts a length of the non-inflatable elongated stabilizing member and a spacing between the stirrup and the body member.

5. The towable recreational craft of claim 1, wherein the stirrup is part of an open-ended boot.

6. The towable recreational craft of claim 5 further comprising a directional guiding member extending from an outer portion of the open-ended boot.

7. The towable recreational craft of claim 5, wherein the non-inflatable elongated stabilizing member is a strap including an adjustable buckle configured to adjust a spacing between the open-ended boot and the body member.

8. The towable recreational craft of claim 7, wherein the strap is nylon and the open-ended boot is plastic.

9. The towable recreational craft of claim 1, wherein the non-inflatable elongated stabilizing member comprises two non-inflatable elongated stabilizing members movably coupled to the body member, the two non-inflatable elongated stabilizing members arranged side-by-side and symmetrically coupled to the body member, each non-inflatable elongated stabilizing member having a foot-accommodating stirrup spaced apart from the body member, a first of the two non-inflatable elongated stabilizing members movable between a position extending away from the aft portion of the body member and a position adjacent a first lateral portion of the body member, and a second of the two non-inflatable elongated stabilizing members movable between a position extending away from the aft portion of the body member and a position adjacent a second lateral portion of the body member.

10. The towable recreational craft of claim 9, wherein each foot-accommodating stirrup is part of an open-ended boot coupled to the corresponding non-inflatable elongated stabilizing member.

11. The towable recreational craft of claim 10, wherein each non-inflatable elongated stabilizing member is adjustable to adjust a spacing between the corresponding open-ended boot and the body member.

12. The towable recreational craft of claim 11 further comprising a directional guiding member protruding from each open-ended boot.

13. The towable recreational craft of claim 11, wherein the body member includes a nylon sheath and each non-inflatable elongated stabilizing member is coupled to the body member by a retaining member.

14. A towable watercraft comprising:

an inflatable body member having a top side, an opposite bottom side, a front portion, a rearward portion, and opposite lateral portions located between the front portion and the rearward portion, a tow-rope hitch coupled to the body member;

two articulating stabilizing straps arranged side-by-side and having a first end portion coupled to the body member, each stabilizing strap having a foot-accommodating stirrup coupled to another end portion of the corresponding stabilizing strap and spaced apart from the body member, a first of the stabilizing straps movable between a position adjacent the rearward portion of the body member and a position adjacent the first lateral portion of the body member, and a second of the stabilizing straps movable between a position adjacent the rearward portion of the body member and a position adjacent the second lateral portion of the body member, the first of the stabilizing straps movable independently of the second of the stabilizing straps.

15. The towable watercraft of claim 14, wherein each foot-accommodating stirrup is part of an open-ended boot coupled to an end portion of the corresponding stabilizing strap.

16. The towable watercraft of claim 15, wherein each stabilizing strap includes a buckle configured to adjust a length of the corresponding stabilizing strap and a spacing between the body member and the corresponding open-ended boot.

17. The towable watercraft of claim 16, wherein the body member includes an outer sheath and each stabilizing strap is coupled to the body member by a corresponding retaining member.

18. The towable watercraft of claim 17 further comprising a directional guiding member extending from each open-ended boot.

19. A towable watercraft for a human rider, the towable watercraft comprising:

an inflatable body member having a top side, an opposite bottom side, a front portion, a rearward portion, and opposite lateral portions located between the front portion and the rearward portion, the body member capable of accommodating a rider's torso such that the rider's legs extend beyond the rearward portion of the body member;

a tow-rope hitch coupled to the body member;

two articulating non-inflatable stabilizing members having a first end portion movably coupled to the body member, a foot-accommodating open-ended boot coupled to a second end portion, opposite the first end portion, of each stabilizing member, each open-ended boot spaced apart from the body member and capable of accommodating the rider's foot when the rider's legs extend beyond the rearward portion of the body member, a first of the stabilizing members movable between a position adjacent the rearward portion of the body member and a position adjacent a lateral portion of the body member, and a second of the stabilizing members movable between a position adjacent the rearward portion of the body member and a position adjacent another lateral portion of the body member, wherein, in use, the stabilizing members allow the rider's legs to move independently between a position adjacent the rearward portion of the body member and a position adjacent one of the lateral portions of the body member when the rider's feet are disposed in the open-ended boots.

20. The towable watercraft of claim 19, wherein the body member includes a nylon sheath, and wherein each stabilizing member is a nylon strap having a buckle configured to adjust a length of the strap and a spacing between the body member and the corresponding open-ended boot.

* * * * *